US010557474B2

(12) United States Patent
Gassmann et al.

(10) Patent No.: US 10,557,474 B2
(45) Date of Patent: Feb. 11, 2020

(54) ROTARY MACHINE AND METHOD FOR THE HEAT EXCHANGE IN A ROTARY MACHINE

(71) Applicant: Sulzer Management AG, Winterthur (CH)

(72) Inventors: Simon Gassmann, Zürich (CH); Benedikt Trottmann, St. Gallen (CH); Marcelo Inforsati, Winterthur (CH); Thomas Felix, Zumikon (CH)

(73) Assignee: SULZER MANAGEMENT AG, Winterthur (CH)

( * ) Notice: Subject to any disclaimer, the term of this patent is extended or adjusted under 35 U.S.C. 154(b) by 27 days.

(21) Appl. No.: 15/116,633

(22) PCT Filed: Feb. 2, 2015

(86) PCT No.: PCT/EP2015/052089

§ 371 (c)(1),
(2) Date: Aug. 4, 2016

(87) PCT Pub. No.: WO2015/124414

PCT Pub. Date: Aug. 27, 2015

(65) Prior Publication Data

US 2016/0348687 A1 Dec. 1, 2016

(30) Foreign Application Priority Data

Feb. 19, 2014 (EP) ..... 14155716

(51) Int. Cl.
*F04D 29/12* (2006.01)
*F04D 29/58* (2006.01)
(Continued)

(52) U.S. Cl.
CPC ..... *F04D 29/128* (2013.01); *F04D 29/5873* (2013.01); *F04D 7/06* (2013.01); *F04D 13/08* (2013.01)

(58) Field of Classification Search
CPC ..... F04D 29/128; F04D 29/08; F04D 29/086; F04D 29/10; F04D 29/108; F04D 29/58; F04D 29/588; F04D 29/5873
(Continued)

(56) References Cited

U.S. PATENT DOCUMENTS 3,459,430 A * 8/1969 Ball ..... F04D 29/108 277/348
3,574,473 A * 4/1971 Gaffal ..... F04D 29/061 415/1
(Continued)

FOREIGN PATENT DOCUMENTS

CN 101410624 A 4/2009
CN 102112785 A 6/2011
(Continued)

OTHER PUBLICATIONS

International Search Report and Written Opinion dated Mar. 10, 2015 in PCT/EP2015/052089, filed Feb. 2, 2015 (with English Translation).

*Primary Examiner* — Nathan C Zollinger
(74) *Attorney, Agent, or Firm* — Global IP Counselors, LLP

(57) ABSTRACT

A rotary machine for conveying a fluid includes a drive unit configured to drive a shaft, an impeller arranged at the shaft, and configured to convey the fluid, at least one mechanical seal configured to seal the shaft, a first and a second heat exchange system configured to cool or heat the mechanical seal, the first heat exchange system configured for direct application of a fluid heat carrier at the mechanical seal and the second heat exchange system comprising a heat exchange jacket capable of having a fluid heat carrier flow therethrough without direct contact with the mechanical seal, the first and the second heat exchange systems forming a common heat exchange system in which a common fluid heat carrier is capable of being circulated, and a fan wheel configured to circulate the common fluid heat carrier in the common heat exchange system.

16 Claims, 2 Drawing Sheets

(51) Int. Cl.
*F04D 13/08* (2006.01)
*F04D 7/06* (2006.01)

(58) Field of Classification Search
USPC ..... 277/359, 360, 370–371, 401, 408
See application file for complete search history.

(56) References Cited

U.S. PATENT DOCUMENTS

| | | | | | |
|---|---|---|---|---|---|
| 4,138,201 | A * | 2/1979 | Dernedde | F04D 29/605 | 376/277 |
| 4,558,870 | A * | 12/1985 | Martinez | F16J 15/3404 | 277/388 |
| 8,696,331 | B2 * | 4/2014 | Cunningham | F04D 13/10 | 310/86 |
| 9,964,213 | B2 * | 5/2018 | Nebout | F04D 7/08 | |
| 2011/0052432 | A1 | 3/2011 | Cunningham et al. | | |

FOREIGN PATENT DOCUMENTS

| | | | | | |
|---|---|---|---|---|---|
| CN | 103470526 | A | | 12/2013 | |
| GB | 993919 | A | * | 6/1965 | F04D 7/04 |
| GB | 1193384 | A | * | 5/1970 | F04D 13/06 |
| JP | H10252688 | A | | 9/1998 | |
| RU | 41097 | U1 | | 10/2004 | |
| RU | 2418197 | C1 | | 5/2011 | |
| RU | 2425256 | C2 | | 7/2011 | |
| WO | 2013129675 | A1 | | 9/2013 | |
| WO | 2013182528 | A1 | | 12/2013 | |

* cited by examiner

ROTARY MACHINE AND METHOD FOR THE HEAT EXCHANGE IN A ROTARY MACHINE

CROSS-REFERENCE TO RELATED APPLICATIONS

This application is a U.S. National Stage application of International Application No. PCT/EP2015/052089, filed Feb. 2, 2015, which claims priority to EP Application No. 14155716.5, filed Feb. 19, 2014, the contents of each of which is hereby incorporated herein by reference.

BACKGROUND

Field of Invention

The invention relates to a rotary machine for conveying a fluids as well as to a method for the heat exchange in such a rotary machine.

Background Information

Rotary machines, such as, for example pumps, are used for the conveyance of fluid media in various technological fields. In the industry of processing hydrocarbons pumps play an important role in the overall processing chain which typically starts at the oil field or at the gas field and must frequently work in conditions which are very challenging from a technical point of view. Thus, it is possible that the medium to be conveyed is present at very high temperatures of up to 200° C., for example, on the conveyance of crude oil. Such high temperatures represent large demands in effort and cost with respect to the pump and in particular also with respect to the mechanical seals in such a pump.

Mechanical seals are typically used for the sealing of the shaft which supports the impeller of the pump and which is driven by the drive unit, for example by a motor. These seals should avoid an emergence of the fluid to be conveyed at or along the shaft. Typically, mechanical seals are configured as sliding seals or sliding ring seals which comprise a stator and an impeller. In this connection the impeller is rotationally fixedly connected to the shaft, whereas the stator is fixed with respect to the pump housing in such a way that it is secured against rotation. During the rotation of the shaft the impeller and the stator thus slide with respect to one another from which a high mechanical loading of these parts results. Having regard to an orderly operation of such mechanical seals it is necessary that these seals are not subjected to too high thermal loads in the operating state. For this reason, in particular for those fluids which are conveyed at a high temperature, the mechanical seals have to be cooled. A too high a temperature in the region of the mechanical seal can lead to material degradation at the sliding surfaces or at other parts of the seal, to damages of the secondary seals, to undesired phase transitions in the fluid to be conveyed, or to changes brought about by thermal effects at the shafts, e.g. deflections.

By the same token with respect to such applications in which the fluid to be conveyed is very cold, for example, in the cryo-technology during the conveyance of liquefied gases, the seals have to be warmed and/or heated in order to ensure an orderly operation.

Thus, depending on the application, it has to be ensured that the mechanical seal and/or its environment is cooled or heated, this means that it is maintained in the correct temperature range via a heat exchange.

Having regard to this heat exchange at mechanical seals, this means to the leading away of or the supply of heat, two possibilities are known in the state of the art. In the first method a heat exchange jacket is provided in the environment of the mechanical seal which, depending on the application, is a cooling jacket for the dissipation of heat or is a heating jacket for the supply of heat. This jacket comprises a hollow space which, for example, surrounds the mechanical seal in the form of a ring space and through which a fluid heat carrier flows which supplies or dissipates the heat. The hollow space has no connection to the space in which the mechanical seal is arranged so that no direct contact is brought about between the heat carrier and the mechanical seal. Having regard to this kind of heat dissipation or heat supply external auxiliary systems, e.g. an external pump, are typically used, in order to convey the fluid heat carrier into the hollow space of the heat exchange jacket and/or to circulate the heat carrier.

The second possibility for the heat exchange is based on a direct contact of the mechanical seal with a fluid heat carrier and is typically referred to as flushing. Hereby the mechanical seal or at least parts thereof are directly applied with a fluid heat carrier in order to dissipate their heat thereby or to supply heat. Having regard to this kind of heat exchange it is known to circulate the fluid heat carrier in a closed circuit which then comprises an external heat exchanger to which the heat carrier dissipates the heat received at the mechanical seal (cooling of the seal), or at which the heat carrier receives the heat which it supplies to the mechanical seal (heating of the seal). The circulation of the heat carrier is in this connection driven by an external pump. Alternatively, or in addition to the external pump also a fan wheel can be provided e.g. at the mechanical seal, the fan wheel being driven by the rotation of the shaft and circulates the fluid heat carrier.

As an alternative to the closed flushing system it is also known to use open systems in which the heat carrier is not circulated in a closed circuit, but rather is extracted from a source and is dissipated after running through the pump, for example, a waste water disposal. Having regard to these open systems one can usually omit an external heat exchanger.

It is further known to provide two separate cooling systems working independently from one another for pumps in which one cooling system works with a cooling jacket and the other one is configured as a flushing system. The two systems can in this connection be operated with different heat carriers. Such solutions are, however, very demanding from a construction point of view, cost intensive and usually have a large demand in space.

SUMMARY

Starting from this state of the art it is thus an object of the invention to suggest a rotary machine having a new heat exchange system for a mechanical seal which is simple from a construction point of view and ensures an efficient cooling or heating of the mechanical seal also for high temperature loads through the heat of or the cold of the fluid to be conveyed. The rotary machine should in particular be suitable for high temperature applications in which the fluid to be conveyed is very hot. Furthermore, it is an object of the invention to suggest a corresponding method for the heat exchange in a rotary machine.

The subject matter of the invention satisfying this object is characterized by the features of the devices and methods described herein.

Thus, a rotary machine for conveying a fluid is suggested in accordance with the invention having a drive unit for driving a shaft, having an impeller arranged at the shaft for conveying the fluid, having at least one mechanical seal for sealing the shaft, having a first and a second heat exchange system for cooling or for heating the mechanical seal, wherein the first heat exchange system is configured for the direct application of a fluid heat carrier at the mechanical seal and the second heat exchange system comprises a heat exchange jacket which can be flowed through by a fluid heat carrier without direct contact with the mechanical seal. The first and the second heat exchange system form a common heat exchange system in which a common fluid heat carrier can be circulated and a fan wheel for the circulation of the fluid heat carrier is provided in the heat exchanger system.

In accordance with the invention it is thus suggested to combine a heat exchange system, which works in accordance with the principle of flushing, with a heat exchange system, which works with a jacket, to a common overall system in which only one fluid heat carrier is circulated whose circulation is driven by the rotary machine itself. This heat exchange system thus combines the advantages of two heat exchange systems without an external circulation apparatus, such as external pumps, being required for this purpose. Therefrom, a very simple compact and efficient solution results from an apparatus point of view by means of which also large amounts of heat can be reliably dissipated (cooling) from the region of the mechanical seal and/or can be supplied to this region (heating).

Due to the high efficiency of the heat exchange the rotary machine in accordance with the invention is in particular suitable also for high temperature applications in which the fluid to be conveyed can have temperatures of up to 200° C.

Having regard to a preferred embodiment the rotary machine is configured as a pump, wherein the drive unit comprises a motor which is arranged in a motor housing.

In this connection it is advantageous when the impeller is arranged in a pump housing which is connected to the motor housing to form an overall housing such that the pump including the motor is enclosed in a single housing. This compact design and outwardly closed design allows the operation of the pump also under complicated environmental conditions.

Depending on the application it can be an advantage when the rotary machine works in a vertical arrangement. It is then preferred that the drive unit is arranged above the pump unit in the normal position of use, since then the drive unit is not loaded by the weight of the impeller.

A further advantageous measure with regard to the cooling, the lubrication and the protection of the drive unit, e.g. with respect to the fluid to be conveyed, is that the motor housing is filled with a sealing liquid in the operating state.

Particularly preferably the fluid heat carrier is then provided as the sealing liquid.

From an apparatus point of view it is advantageous when the impeller is driven for the circulation of the heat carrier by the drive unit and is preferably provided at the side of the drive unit remote from the impeller.

In accordance with a particularly preferred application, the rotary machine in accordance with the invention is configured as an undersea pump.

A preferred use of the rotary machine is for the conveyance of hot fluids whose temperature amounts to at least 150° C.

In accordance with the invention a method is suggested for the heat exchange in a rotary machine for conveying a fluid which has a drive unit for driving a shaft, an impeller arranged at the shaft for the conveying of fluid, as well as at least one mechanical seal for sealing the shaft in which method the mechanical seal is cooled or heated with a first and a second heat exchange system, wherein the mechanical seal is directly applied with a fluid heat carrier by the first heat exchange system and a fluid heat carrier flows through a heat jacket without direct contact with the mechanical seal in the second heat exchange system. The first and the second heat exchange systems are connected to a common heat exchange system in which a common fluid heat carrier is circulated, wherein the fluid heat carrier is circulated by a fan wheel in the heat exchange system.

The advantages of this method correspond to those which have already been explained in connection with the rotary machine in accordance with the invention.

In a preferred embodiment the common heat exchange system is a cooling system.

The method is particularly suitable when the rotary machine is a pump, wherein the drive unit comprises a motor which is arranged in a motor housing, wherein the fluid heat carrier is used as a sealing liquid with which the motor housing is filled and wherein the fan wheel is preferably driven by the drive unit.

It is an advantageous measure when the fluid heat carrier is a water-based liquid, since these liquids are generally cost-effective, have a sufficient heat capacity and are not pollutive. In particular, mixtures of water and glycol are suitable as heat carriers.

The method in accordance with the invention is in particular suitable for high temperature applications in which the liquid to be conveyed has a temperature of at least 150° C.

In particular the method in accordance with the invention is also suitable for such applications in which the rotary machine is an undersea pump.

Further advantageous measures and embodiments of the invention result from the dependent claims.

BRIEF DESCRIPTION OF THE DRAWINGS

Referring now to the attached drawings which form a part of this original disclosure.

DETAILED DESCRIPTION OF THE EMBODIMENTS

In the following description of a rotary machine in accordance with the invention and of a method in accordance with the invention for the heat exchange, reference is made with an exemplary character to the case of application particularly relevant in practice, in which the rotary machine is a pump. It is however understood that the invention is not limited to such cases, but rather also comprises all other rotary machines in which a mechanical seal is provided for the sealing of the shaft. The rotary machine can, for example, also be a compressor, a turbine or a generator.

Furthermore, it is assumed with respect to the heat exchanger having an exemplary character that the heat exchange is a cooling device in which heat is thus extracted from the system. It is understood that the invention also comprises applications in an analogous manner in which the heat exchange is heating, this means applications in which heat is supplied to the system.

Figure 1:
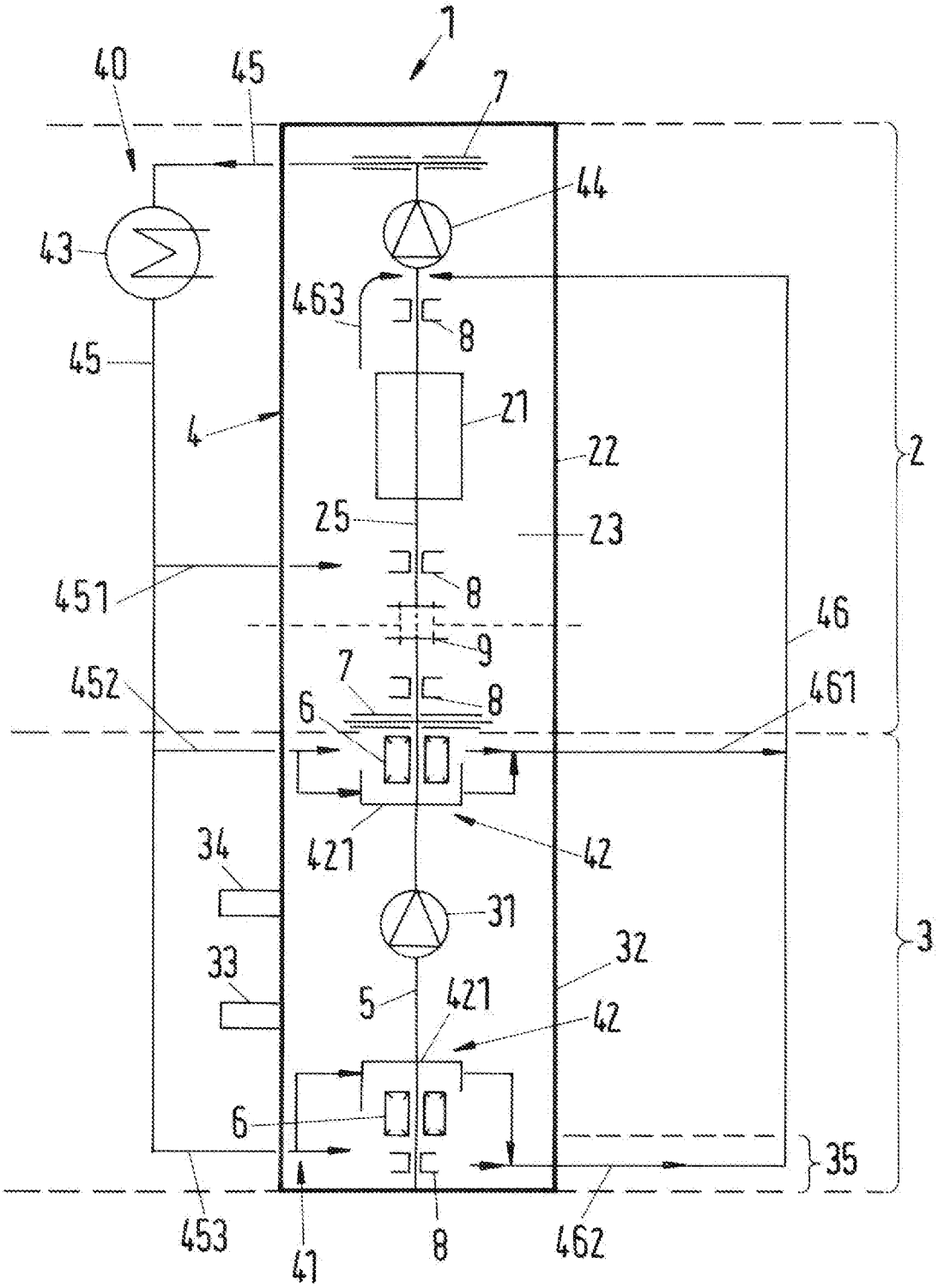
FIG. 1 is a schematic illustration of an embodiment of a rotary machine in accordance with the invention configured as a pump.

In a very schematic illustration FIG. 1 shows a rotary machine which is configured as a pump and is totally referred to with the reference numeral 1. The pump 1 comprises a drive unit 2 having a motor 21 which is arranged in a motor housing 22 and in the present instance is configured as an electric motor. The motor 21 has a motor shaft 25 which represents the rotor of the electric motor.

Figure 2:
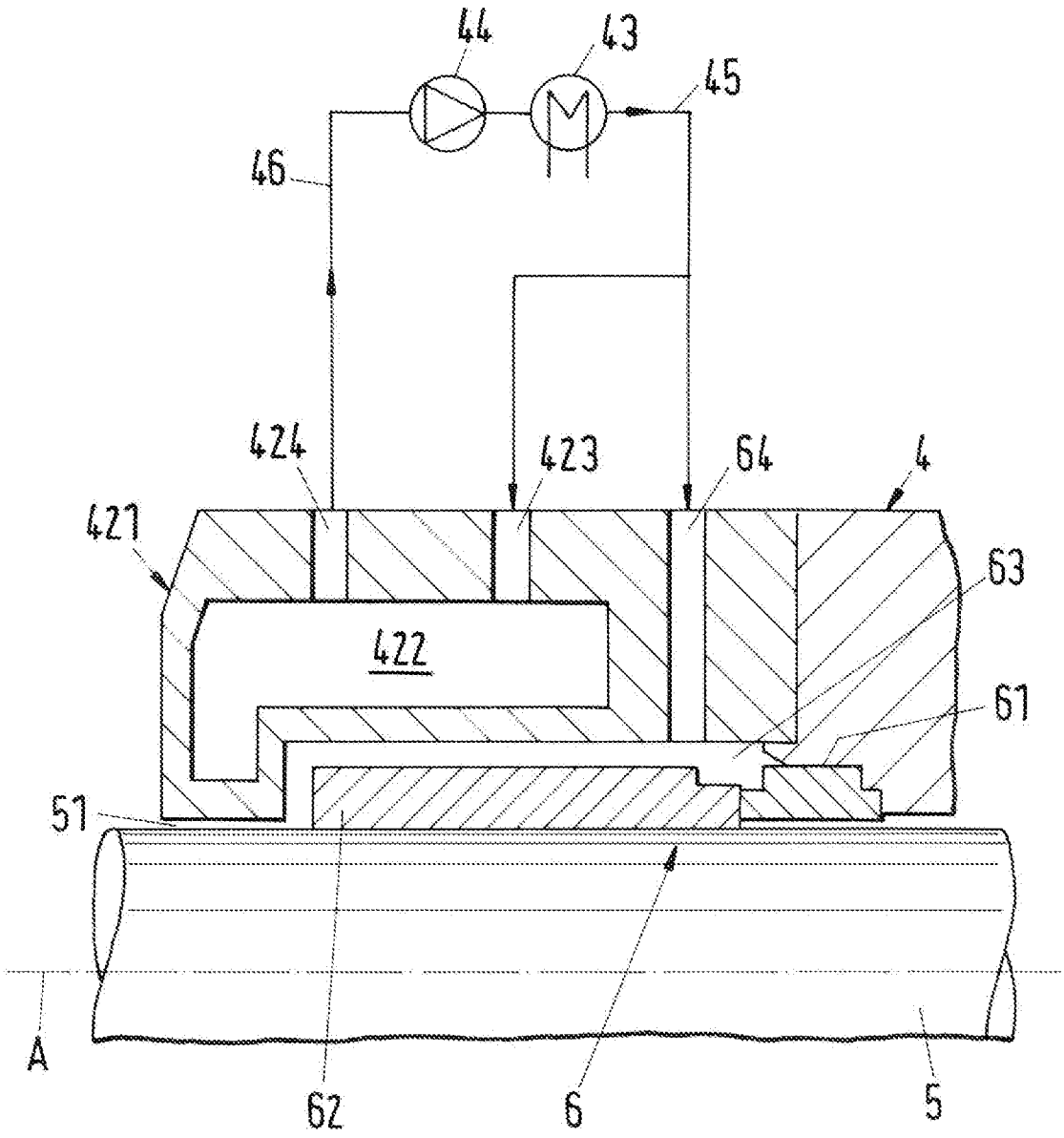
FIG. 2 is a schematic partly sectioned illustration of a mechanical seal with components of a heat exchange system.

The pump 1 further comprises a pump unit 3 having a pump housing 32 in which an impeller 31 is disposed for conveying a fluid. The impeller 31 is arranged at a shaft 5 which is connected to the motor shaft 25 by a clutch 9 and is thus driven by the motor 21 and is displaced into rotation about its longitudinal axis A (FIG. 2).

The motor housing 22 and the pump housing 32 are fixedly connected to one another, for example are screwed to one another with a plurality of screws, and thus form an overall housing 4 for this drive unit 2 and the pump unit 3.

The shaft 5 and the motor shaft 25 are supported in a manner known per se by a plurality of axial bearings 7 and radial bearings 8.

The pump unit 3 further comprises an inlet 33 through which the fluid to be conveyed is sucked into the pump housing 32 through the effect of the impeller 31, as well as an outlet 34 through which the fluid to be conveyed is pushed out.

In order to seal the shaft 5, two mechanical seals 6 are disposed in the pump, namely a first seal, which seals the shaft 5 at the boundary between the pump unit 3 and the drive unit 2, such that the fluid to be conveyed cannot arrive along the shaft 5 in the drive unit 2 and a second seal which is disposed beneath the impeller 31 in accordance with the illustration and which prevents the penetration of the fluid to be conveyed along the shaft 5 into a storage space 35 provided beneath the impeller 31 in accordance with the illustration in which storage space a radial bearing 8 is arranged.

The embodiment of the rotary machine in accordance with the invention explained in this instance is a multistage process pump for high temperature applications, in which the fluid to be conveyed has very high temperatures of, for example, 150° C., 180° C., 200° C. or even more. Such high temperatures can, for example, arise during the extraction of natural gas or crude oil, since oil fields exist in which the oil is present at temperatures of 200° C.

More specifically the embodiment described in this instance is configured as a subsea pump which is mounted at the bottom of the sea and works there, e.g. for the extraction of crude oil or natural gas. Specifically for such applications an extremely compact manner of construction and an as high as possible operational safety and reliability are indispensable.

As is common for subsea applications the pump 1 is configured in a vertical arrangement having an above lying drive unit 2, this means that the pump 1 is illustrated in its usual position of use in FIG. 1. The motor housing 22 of the drive unit 2 is filled with a sealing liquid 23 in a manner known per se, the sealing liquid serving for the cooling of the mechanical components and of the electrical components of the motor 21, as well as for their lubrication. The storage space 35 arranged beneath the impeller 31 is also filled with the sealing liquid 23.

In FIG. 2 one of the mechanical seals 6 is illustrated in a starkly simplified schematic manner. Mechanical seals are generally well known to a person of ordinary skill in the art and for this reason do not require an in-depth explanation. For this reason and because it is sufficient for the explanation, many details, such as for example, the fixation of the parts of the seal 6 or secondary seals, e.g. O-rings, are not illustrated in FIG. 2.

Typically mechanical seals are configured as sliding seals or as sliding ring seals which comprise a stator 61 and a rotor 62. In this connection the rotor is rotationally fixedly connected to the shaft 5, whereas the stator 61 is fixed with respect to the overall housing 4 and/or with respect to the pump housing 32 in such a way that it is secured against rotation. During the rotation of the shaft 5 the rotor 62 and the stator 61 thus glide with respect to one another.

Having regard to the orderly functioning of the mechanical seals 6, it is essential that the seal 6 does not become too hot (with respect to high temperature applications) or not to cold (with respect to low temperature applications). For this purpose a new method for heat exchange with the mechanical seal 6 is suggested in accordance with the invention that will now be explained in the following with reference to the embodiment illustrated in the FIG. 1 and FIG. 2.

A first heat exchange system 41 and a second heat exchange system 42 are provided—in this instance cooling systems—which are connected to a common heat exchange system 40. This integrated heat exchange system 40 serves for the cooling of the mechanical seal 6.

The first heat exchange system 41 for the cooling of the mechanical seal 6 is a so-called flushing system in which the mechanical seal 6 or at least parts thereof are directly supplied with a fluid heat carrier—in this instance a cooling liquid. As is shown in FIG. 2 the mechanical seal is arranged in a sealing space 63 which, for example is configured as a ring space and which surrounds the shaft 5. The heat carrier is introduced into the sealing space 63 through an inlet opening 64. Furthermore, a non-illustrated outlet opening is provided at the sealing space 63 through which the heat carrier can exit the sealing space 63 again. The outlet opening is, for example, rotated by 45° or by 90° with respect to the longitudinal axis A of the inlet opening 64. During the operation of the pump 1 the sealing space 63 is substantially completely filled with the heat carrier, this means that as much coolant (heat carrier) flows through the inlet opening 64 into the sealing space 63 per unit time, as exits from the sealing space 63 through the outlet opening. The heat exchange—in this instance thus the cooling—therefore takes place through the direct contact of the heat carrier with the mechanical seal 6 and with the heat carrier dissipating heat from the seal 6 and thus cooling the seal 6.

The second heat exchange system 42 for the cooling of the mechanical seal 6 comprises a heat exchange jacket 421 which in the present embodiment is a cooling jacket 421. Having regard to this kind of heat exchange no direct physical contact of the mechanical seal 6 with the heat carrier—in this instance the coolant—is brought about. The cooling jacket 421 comprises a hollow space 422 which is, for example, configured as a ring space and surrounds the complete shaft 5. An inlet 43 is provided through which the heat carrier can be introduced into the hollow space 422 and an outlet 44 is provided through which the heat carrier can exit the hollow space 422. The hollow space 422 is completely filled with the heat carrier during the operation, the heat carrier being circulated through the hollow space 422. Having regard to this kind of heat exchange and/or cooling there is no direct physical contact between the heat carrier and the mechanical seal 6.

As is evident in particular from FIG. 1 the jacket 421 is respectively arranged at the hotter side of the mechanical seal 6, this thus means at the side of the seal 6 at which the higher temperature is present in the operating state. The pump housing 32 is filled in the operating state with the fluid to be conveyed. This means, for example, with the hot crude oil—with the exception of the bearing space 35. The fluid to be conveyed is in particular also cooled in the vicinity of the seal 6 through the coolant jacket 421, this means, for example, also in the gap 51 which leads to the seal 6. Through this cooling of the fluid to be conveyed in the direct vicinity of the mechanical seal 6, the introduction of heat into the seal 6 is thus significantly reduced by the fluid to be conveyed, this corresponds to a cooling of the seal 6.

In accordance with the invention the first heat exchange system 41 and the second heat exchange system 42 are now combined to the integrated common heat exchange system 40. This has the consequence that a common fluid heat carrier must be made available for the common heat exchange system 40. Whereas also different fluid heat carriers could be used for first and second heat exchange systems separate from one another, in accordance with the solution of the invention a common fluid heat carrier is thus required which can, for example, be the same heat carrier as that of the first or of the second heat exchange system.

Particularly preferably the sealing liquid 23 is a fluid heat carrier for the common heat exchange system 40 which is also used for the lubrication and for the cooling of the motor 21 and/or of the drive unit 2. This has the advantage that only one single liquid has to be provided which is used both as a sealing liquid 23, as well as a fluid heat carrier for the heat exchange system 40. Specifically for subsea applications this measure is very positive with regard to the demand from an apparatus point of view.

Water-based liquids, such as, for example, a mixture of water and glycol are In particular suitable as a fluid heat carrier.

As is illustrated in FIG. 1 the common heat exchange system 40 is configured as a closed system, this thus means a cooling system or a cooling circuit in which the fluid heat carrier is circulated. Having regard to the circulation of the heat carrier a fan wheel 44 is arranged at the motor shaft 25 and is thus driven by the drive unit 2, specifically by the rotation of the motor shaft 25 of the motor 21.

The fan wheel 44 conveys the heat carrier via a main line 45 to a heat exchanger 43 in which the heat carrier dissipates heat present at the mechanical seal 6 or in the drive unit 2 or in the storage space 35 and is cooled thereby. Downstream of the heat exchanger 43 a plurality of lines now branch away from the main line 45, initially a first line 451 through which the heat carrier enters into the motor housing 22, as is symbolically indicated by the arrow at the line 451. The heat carrier fills the motor housing and in this instance serves as the sealing liquid 23 in this instance.

Further downstream a second line 452 branches away from the main line 45 through which the heat carrier arrives at the cooling system for the mechanical seal 6. The second line 452 in turn branches away into a branch which leads to the inlet 423 (FIG. 2) of the cooling jacket 421 and into a branch which leads to the inlet opening 64 of the sealing space 63. From the outlet opening (not illustrated) out of the sealing space 63 and the outlet 424 of the hollow space 422 of the cooling jacket 421, the fluid heat carrier respectively arrives in the return line 46 via respective lines which are combined to the line 461.

Finally, the main line 45 transitions into a third line 453 through which the heat carrier arrives at the cooling system for the lowest mechanical seal from an illustration point of view. The third line 453 in turn branches into a branch which leads to the inlet 423 (FIG. 2) of the cooling jacket 421 and into a branch which leads to the inlet opening 64 of the sealing space 63. Having regard to the embodiment described in this example, this sealing space 63 is connected to the bearing space 35, such that the heat carrier can also arrive in the storage space 35 via the same line which leads to the inlet opening 64 of the sealing space 63. From the outlet opening of the sealing space 63 and the outlet 424 of the hollow space 422 of the cooling jacket 421, the fluid heat carrier arrives in the return line 46 via respective lines which are combined to the line 462.

The heat carrier again arrives in the region of the fan wheel 44 which drives the circulation of the heat carrier in the closed circuit through the return line 46. Also the heat carrier introduced into the motor housing 22 via the first line 451 is recirculated by the effect of the fan wheel 44 as is indicated by the arrow having the reference numeral 463.

The fan wheel 44 for the circulation of the fluid heat carrier is preferably provided at the side of the drive unit 2 remote from the impeller 31 of the pump unit 3 or at the side of the motor 21 remote from the impeller 31 respectively.

In this manner the first heat exchange system 41 for the mechanical seal 6 and the second heat exchange system 42 for the mechanical seal 6 are connected to a common heat exchange system 40, such that an integral heat exchange system for the mechanical seal 6 is formed. At the same time the common heat exchange system 40 also serves the purpose of supplying the motor housing with the sealing liquid 23 which is identical to the fluid heat carrier.

As is common, in particular for subsea applications and/or for subsea pumps, the sealing liquid 23 is maintained at a higher pressure in the pump housing 22 than the fluid to be conveyed in the pump housing 32. The pressure of the sealing liquid 23 in the motor housing 22 is, for example, 20-25 bar higher than the pressure in the pump housing 32.

The method in accordance with the invention and/or the rotary machine in accordance with the invention are suitable for a numerous number of applications. Thus, they are in particular suitable for high temperature applications and specifically for such applications in the subsea region. The rotary machine in accordance with the invention configured as a pump can be used for the conveyance of oil, gas, sea water or also so-called produced water. The pump can be configured as a single stage pump, as a multi-stage pump or also as a hybrid pump having the corresponding impellers adapted thereto. Designs as single stage pumps and also as multi-stage pumps are possible.

In particular for subsea applications the solution provided in accordance with the invention represents an efficient, reliable, simple and compact possibility from an apparatus point of view for cooling and/or for the heating of mechanical seals by means of its integrated heat exchange system.

As has already been mentioned with regard to an embodiment of the pump as a subsea pump, a vertical arrangement is preferred in which the drive unit 2 is arranged above the pump unit 3. Naturally also horizontal arrangements are possible in which the drive unit and the pump unit 3 are arranged next to one another. Such an arrangement is frequently preferred when the pump is not used in the subsea operation, but rather, for example, on the land, or at ships or on bore platforms.

As already mentioned the rotary machine in accordance with the invention and/or the method in accordance with the invention are also suitable for low temperature applications, for example, for the pumping of liquid gases in cryotechnology. Having regard to such applications, the mechanical seals are warmed or heated by the heat carrier. The heat exchanger 43 then serves the purpose of supplying heat to the heat carrier and to then transport this in an analog manner to the mechanical seals. Having regard to such applications the heat exchange jacket of the second heat exchange system is then arranged at the colder side of the mechanical seal 6, this means at that side of the mechanical seal 6 which faces the region of lower temperature in the operating state.

Naturally, the invention is not limited to pumps, but it also suitable for all other kinds of rotary machines in which mechanical seals are provided, for example compressors, turbines or generators.

The invention claimed is:

1. A rotary machine for conveying a fluid, comprising:

a drive unit configured to drive a shaft;

an impeller arranged at the shaft, and configured to convey the fluid;

at least one mechanical seal configured to seal the shaft;

a first and a second heat exchange system configured to cool or heat the mechanical seal, the first heat exchange system comprising an inlet and configured for direct application of a fluid heat carrier at the mechanical seal and the second heat exchange system comprising a heat exchange jacket capable of having a fluid heat carrier flow therethrough without direct contact with the mechanical seal and comprising a hollow space having an inlet and an outlet, the fluid heat carrier of the second heat exchange system of passing from the inlet of the hollow space to the outlet of the hollow space without being in fluid communication with the inlet of the first heat exchange system, and the inlet for the first heat exchange system being different from both the inlet and the outlet for the second heat exchange system, the second heat exchange system at least partially defining the flow path of the first heat exchange system, and the first and the second heat exchange systems forming a common heat exchange system in which a common fluid heat carrier comprising the fluid heat carrier of the first heat exchange system and the fluid heat carrier of the second heat exchange system is capable of being circulated; and a fan wheel configured to circulate the common fluid heat carrier in the common heat exchange system.

2. A rotary machine in accordance with claim 1, wherein the rotary machine is a pump, and the drive unit comprises a motor arranged in a motor housing.

3. A rotary machine in accordance with claim 2, wherein the impeller is arranged in a pump housing connected to the motor housing forming a common housing.

4. A rotary machine in accordance with claim 1, wherein the drive unit is arranged above a pump unit in a normal position of use.

5. A rotary machine in accordance with claim 2, wherein the motor housing is filled with a sealing liquid in an operating state.

6. A rotary machine in accordance with claim 5, wherein the sealing liquid is the common fluid heat carrier.

7. A rotary machine in accordance with claim 1, wherein the fan wheel is driven for the circulation of the common fluid heat carrier by the drive unit and is disposed at a side of the drive unit remote from the impeller.

8. A rotary machine in accordance with claim 1, wherein the rotary machine is an undersea pump.

9. A method, comprising:

operating the rotary machine of claim 1 to convey hot fluids having temperature of at least 150° C.

10. A method for heat exchange in a rotary machine for conveying a fluid, the rotary machine having a drive unit for driving a shaft, an impeller arranged at the shaft for conveying the fluid, at least one mechanical seal for sealing the shaft, the method comprising:

cooling or heating the mechanical seal with a first and a second heat exchange system, by directly applying a fluid heat carrier by the first heat exchange system, the first heat exchange system including an inlet and the second heat exchange system including a hollow space having an inlet and an outlet for a fluid heat carrier, the fluid heat carrier of the second heat exchange system is capable of passing from the inlet of the hollow space to the outlet of the hollow space without being in fluid communication with the inlet of the first heat exchange system, and the inlet for the first heat exchange system being different from both the inlet and the outlet for the second heat exchange system; and flowing the fluid heat carrier of the second heat exchange system through a heat exchange jacket without direct contact with the mechanical seal in the second heat exchange system, the second heat exchange system at least partially defining the flow path of the first heat exchange system;

the first and the second heat exchange systems being connected to a common heat exchange system, circulating a common fluid heat carrier comprising the fluid heat carrier of the first heat exchange system and the fluid heat carrier of the second heat exchange system in the common heat exchange system; and circulating the common fluid heat carrier in the common heat exchange system by a fan wheel.

11. A method in accordance with claim 10, wherein the common heat exchange system is a cooling system.

12. A method in accordance with claim 10, wherein the rotary machine is a pump, and the drive unit comprises a motor arranged in a motor housing, using the common fluid heat carrier as a sealing liquid with which the motor housing is filled.

13. A method in accordance with claim 10, wherein the common fluid heat carrier is a water-based liquid.

14. A method in accordance with claim 10, wherein the fluid to be conveyed has a temperature of at least 150° C.

15. A method in accordance with claim 10, wherein the rotary machine is an undersea pump.

16. A method in accordance with claim 10, wherein the fan wheel is driven by the drive unit.

* * * * *